US010060036B2

(12) United States Patent
Wu et al.

(10) Patent No.: US 10,060,036 B2
(45) Date of Patent: Aug. 28, 2018

(54) PLATED-LAYER STRUCTURE FOR IMPROVING INTERFACE STRESS BETWEEN ALUMINIUM NITRIDE SUBSTRATE AND COPPER-PLATED LAYER

(71) Applicant: National Chung-Shan Institute of Science and Technology, Taoyuan County (TW)

(72) Inventors: Chun-Te Wu, Taoyuan County (TW); Yang-Kuo Kuo, Taoyuan County (TW)

(73) Assignee: NATIONAL CHUNG-SHAN INSTITUTE OF SCIENCE AND TECHNOLOGY, Taoyuan County (TW)

( * ) Notice: Subject to any disclaimer, the term of this patent is extended or adjusted under 35 U.S.C. 154(b) by 506 days.

(21) Appl. No.: 14/959,285

(22) Filed: Dec. 4, 2015

(65) Prior Publication Data

US 2017/0159187 A1 Jun. 8, 2017

(51) Int. Cl.
*B21D 39/00* (2006.01)
*C23C 28/02* (2006.01)

(52) U.S. Cl.
CPC ..... *C23C 28/023* (2013.01); *C23C 28/021* (2013.01)

(58) Field of Classification Search
None
See application file for complete search history.

(56) References Cited

U.S. PATENT DOCUMENTS 5,071,518 A * 12/1991 Pan ..... H01L 21/4846 205/122
5,134,463 A * 7/1992 Yamaguchi ..... H01L 23/24 257/677
5,182,628 A * 1/1993 Izawa ..... H01L 23/3735 257/707

* cited by examiner

*Primary Examiner* — Daniel J. Schleis
(74) *Attorney, Agent, or Firm* — Chun-Ming Shih

(57) ABSTRACT

A yellow light photolithographic process and an electroplating process are performed multiple times to produce copper plated layers on the aluminum nitride (AlN) substrate. The copper plated layers are plated in sequence into a stack structure with each layer having reduced length. The parameters of the yellow light photolithographic process can be adjusted, such that each copper plated layer is formed horizontally for a predetermined length into a stack structure of step layers tapering off upward, while a predetermined angle is formed by the tangent line passing through edges of the respective step layers, and the surface of the AlN substrate. An adhesion layer, a copper seed layer, a first copper plated layer, a second copper plated layer, a third copper plated layer, and a nickel plated layer are formed in sequence on the AlN substrate, to form a metalized circuit of multi-layer stack.

8 Claims, 1 Drawing Sheet

PLATED-LAYER STRUCTURE FOR IMPROVING INTERFACE STRESS BETWEEN ALUMINIUM NITRIDE SUBSTRATE AND COPPER-PLATED LAYER

BACKGROUND OF THE INVENTION

Field of the Invention

The present invention relates to a structure for improving interface stress, and in particular to a plated-layer structure for improving interface stress between AlN substrate and copper-plated layer.

The Prior Arts

Presently, the most popular research for the three-dimensional (3D) integrated circuit (IC) package in the semiconductor industry is the copper filling technology for the Through-Silicon Via. In applying the Through-Silicon Via technology into the IC packaging, it has the advantages of compact size, high density, good electric conduction, low power consumption, and superior performance. Therefore, presently, it is mainly utilized in manufacturing the DRAM products. However, the electrical current the silicon material is able to sustain is rather limited, and its insulation is poor, such that an overlarge current could damage the silicon material.

In this respect, AlN has the superb characteristics of high heat conduction, high insulation, having its thermal expansion coefficient close to that of GaN, AlGaN semiconductor material. As such, AlGaN substrate may replace silicon and Sapphire substrates in the application of packaging for high power semiconductor components (IGBT, MOSFET), and high power light-emitting-diode (LED), to achieve better performance.

When the Through Silicon Via technology is used in producing AlN wafer, it is defined and referred to as TAV (Through Aluminum Nitride Via) technology. In application, vias are first formed on AlN substrate through using laser or Inductively Coupled Plasma (ICP), then the electric conduction seed layer is formed on the entire surface of the substrate and in vias by means of sputtering or chemical plating (electroless plating). Finally, the electroplating process is used to combine copper and other conductive material (for example, tungsten), to fill in TAV or on the surface of the substrate, by means of all-fill or hole wall plating, as shown in FIG. 1. In this respect, TAV is not only capable of providing electric connection, but it can also provide heat dissipation route, to raise the heat dissipation capability of the entire system.

The application of AlN substrate into high power LED packaging has the advantages of achieving system integration and high heat dissipation route of high power LED, increasing its life span, raising its light emitting efficiency and stability. However, the copper and AlN utilized in the copper via of AlN substrate can be damaged, due to mismatching of thermal expansion coefficients and the ensuing over deformation. When high power LED is used for illumination purpose in a severe environment, its reliability is questionable and is an issue of concern.

In the TAV process and the metal film plating process, the AlN substrate is subject to high process temperature, that could lead to protrusion of material filled in the hole, thus leading to reduced yield. Since via filling is realized through filling conductive material to its center through its side wall, in case the via is not fully filled to create via gap, then the overall resistance will increase to reduce the transmission efficiency for the electric signal. In case it is used in a high temperature environment, the air in the via gap tends to inflate to cause via explosion. Therefore, for the wafer thus obtained, the stress remains tends to affect adversely the reliability of the LED package in applications, such as detaching of the via-filled material from the copper wall, and adhesion of LED package with the substrate.

The manufacturing processes for the surface metal route and the via copper filling for an AlN substrate are as follows: Firstly, forming vias on AlN substrate through using Laser or Inductively Coupled Plasma (ICP). Next, forming a conductive seed layer in the vias and the entire surface of the substrate, by means of sputtering or chemical plating (electroless plating). And finally, using copper or other conductive materials (for example, tungsten) to fill in TAV or the entire surface of the substrate through electroplating, by means of filling all the through-holes or plating the entire hole wall.

In order to raise its heat dissipation capability and electric conduction efficiency, the copper layer thickness of the metal route on the surface of the ceramic substrate is increased. For the metalized ceramic substrate presently available on the market, the thickness of the copper plated layer is 50~100 μm. The thickness of the copper plated layer can be increased further, to meet the specific requirements of the heat dissipation and electric conduction.

For a metalized AlN substrate having TAV thus obtained, pressure cooker test (PCT) (121° C./100% R.H./33 psia (2 atm), 96 hrs) and TST(−40° C.~125° C., 200 cycles) are performed to test its reliability. The results show that cracks could occur at the edges of the copper plated layer for the AlN substrate. From a major axis maximum stress distribution obtained through Finite Element Simulation Analysis, it can be known that, in a reduced temperature, for the edges of a copper plated layer of an AlN substrate, the maximum stress for the major axis is a pulling stress. It is assumed that this pulling stress is the major cause of substrate cracks.

Therefore, presently, the design and performance of AlN substrate and surface layer thereon is not quite satisfactory, and it leaves much room for improvement.

SUMMARY OF THE INVENTION

In view of the problems and drawbacks of the prior art, the present invention provides a plated-layer structure for improving interface stress between AlN substrate and copper plated layer, to overcome the shortcomings of the prior art. In the present invention, a yellow light photolithographic process and an electroplating process are used to produce a stack structure of copper plated layers, to reduce the thickness of the first copper plated layer directly in contact with the AlN substrate, and the angle formed by a tangent line passing through edges of the copper plated layer and surface of the AlN substrate. The stack structure of copper plated layers is capable of reducing the stress of interface between the copper plated layer and the AlN substrate, to raise effectively the reliability of the AlN substrate.

The present invention provides a plated-layer structure for improving interface stress between an AlN substrate and a copper plated layer, comprising: an aluminum nitride substrate; an adhesion layer, sputtered on the aluminum nitride (AlN) substrate for a first predetermined length horizontally, such that a tangent line passing through its edge forms a predetermined angle with a surface of the aluminum nitride substrate; a copper seed layer, sputtered on the adhesion layer for the first predetermined length horizontally, such that a tangent line passing through its edge forms the predetermined angle with the surface of the aluminum nitride substrate; a first copper plated layer, electroplated on the copper seed layer for the first predetermined length horizontally, such that a tangent line passing through its edge forms the predetermined angle with the surface of the aluminum nitride substrate; a second copper plated layer, electroplated on the first copper plated layer for a second predetermined length horizontally, such that a tangent line passing through its edge forms the predetermined angle with the surface of the aluminum nitride substrate; a third copper plated layer, electroplated on the second copper plated layer for a third predetermined length horizontally, such that a tangent line passing through its edge forms the predetermined angle with the surface of the aluminum nitride substrate; and a nickel plated layer, plated to cover and wrap around the adhesion layer, the copper seed layer, the first copper plated layer, the second copper plated layer, and the third copper plated layer, to prevent copper from being oxidized or dispersed. The adhesion layer, the copper seed layer, the first copper plated layer, the second copper plated layer, the third copper plated layer, and the nickel plated layer together form a stack structure of step layers in sequence tapering off upward.

In the structure mentioned above, the adhesion layer is made of Ti, or Ti/W alloy.

In the structure mentioned above, the first predetermined length is greater than the second predetermined length, while the second predetermined length is greater than the third predetermined length.

In the present invention, the yellow light photolithographic process and the electroplating process are used multiple times to produce copper plated layer on the aluminum nitride (AlN) substrate. In such a structure, the copper plated layers are plated in sequence into a stack structure with each layer having reduced length. The parameters of the yellow light photolithographic process can be adjusted, such that each copper plated layer is formed horizontally for a predetermined length to form a stack structure of step-layer in sequence tapering off upward, while a predetermined angle is formed by the tangent line passing through edges of the respective step layer, and the surface of the aluminum nitride (AlN) substrate. In this way, an adhesion layer, a copper seed layer, a first copper plated layer, a second copper plated layer, a third copper plated layer, and a nickel plated layer are formed in sequence on an aluminum nitride (AlN) substrate, to form into a metalized circuit of multi-layer stack. As such, the stack structure of step layers (formed by the first copper plated layer, the second copper plated layer, and the third copper plated layer) may have the same thickness as the one-piece copper plated layer not having steps. Since the first copper plated layer in direct contact with the aluminum nitride (AlN) substrate is thinner than the entire stack structure, the stress on the AlN substrate is reduced. In addition, for the stack structure of step layers, the angle formed by the tangent line passing through edges of the respective copper plated layers, and the surface of the aluminum nitride (AlN) substrate, is less than the angle formed by the tangent line passing through edges of the respective layers not having steps. As such, the stack structure of step layers is able to reduce significantly the stress between the first copper plated layer and the surface of the aluminum nitride (AlN) substrate, and raise the reliability of the aluminum nitride (AlN) substrate. Compared with the etching process, the present invention is easy to operate and control.

As mentioned earlier, in the present invention, the yellow light photolithographic process and the electroplating process are used multiple times. Firstly, an adhesion layer made of Ti or Ti/W alloy having a thickness 100 nm to 500 nm is formed on the aluminum nitride (AlN) substrate with a first predetermined length. Next, a copper seed layer having thickness of 0.8 μm to 1 μm is formed on the adhesion layer with a first predetermined length, by means of sputtering or chemical plating (electroless plating). Then, a first copper plated layer having thickness of 10 μm to 30 μm is formed on the copper seed layer with a first predetermined length through electroplating. Subsequently, a second copper plated layer having thickness of 10 μm to 30 μm is formed on the first copper plated layer with a second predetermined length through electroplating. Then, a third copper plated layer having thickness of 10 μm to 30 μm is formed on the second copper plated layer with a third predetermined length through electroplating. Finally, a nickel plated layer having thickness of 100 nm to 500 nm is plated around the adhesion layer, the copper seed layer, the first copper plated layer, the second copper plated layer, and the third copper plated layer, to prevent copper from being oxidized and dispersed.

Summing up the above, in the present invention, two approaches are adopted to reduce the stress on the aluminum nitride (AlN) substrate effected by the copper plated layer:

1. The copper plated layer of the existing technology is made into a stack structure of step layers formed by a first copper plated layer, a second copper plated layer, and a third copper plated layer (the thickness of the stack structure is the same as that of the copper plated layer), so that the thickness of the first copper plated layer in direct contact with the aluminum nitride (AlN) substrate is reduced, in achieving reduced stress for the substrate.

2. Through the stack structure of step layers, the angle formed by a tangent line passing through edges of the step layers and the surface of the substrate is reduced, so that the stress on the aluminum nitride (AlN) substrate is reduced.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from this detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings.

Figure 1:
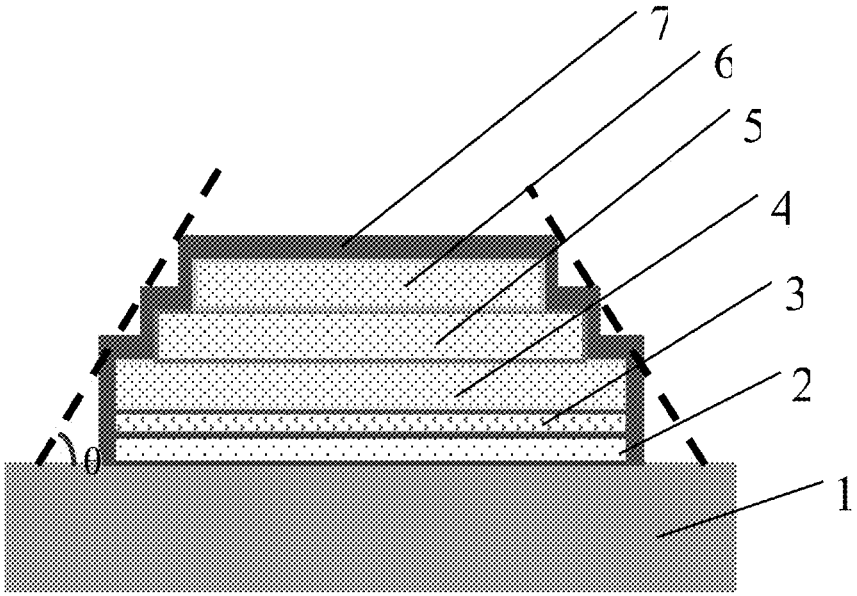
FIG. 1 is a cross section view of a plated-layer structure for improving interface stress between an AlN substrate and a copper-plated layer according to an embodiment of the present invention.

Firstly, refer to FIG. 1 for a cross section view of a plated-layer structure for improving interface stress between an AlN substrate and a copper-plated layer according to an embodiment of the present invention. As shown in FIG. 1, the plated-layer structure for improving interface stress between an AlN substrate and a copper-plated layer includes, an aluminum nitride substrate 1, an adhesion layer 2, a copper seed layer 3, a first copper plated layer 4, a second copper plated layer 5, a third copper plated layer 6, and a nickel plated layer 7. Wherein, the adhesion layer 2 is sputtered on the aluminum nitride (AlN) substrate 1 for a first predetermined length horizontally, such that a tangent line passing through its edge forms a predetermined angle with a surface of the aluminum nitride substrate 1. The copper seed layer 3 is sputtered on the adhesion layer 2 for a first predetermined length horizontally, such that a tangent line passing through its edge forms the predetermined angle with the surface of the aluminum nitride substrate 1. The first copper plated layer 4 is electroplated on the copper seed layer 3 for the first predetermined length horizontally, such that a tangent line passing through its edge forms the predetermined angle with the surface of the aluminum nitride substrate 1. The second copper plated layer 5 is electroplated on the first copper plated layer 4 for a second predetermined length horizontally, such that the tangent line passing through its edge forms the predetermined angle with the surface of the aluminum nitride substrate 1. The third copper plated layer 6 is electroplated on the second copper plated layer 5 for a third predetermined length horizontally, such that the tangent line passing through its edge forms the predetermined angle with the surface of the aluminum nitride substrate 1. And the nickel plated layer 7 is plated to cover and wrap around the adhesion layer 2, the copper seed layer 3, the first copper plated layer 4, the second copper plated layer 5, and the third copper plated layer 6, to prevent copper from being oxidized or dispersed.

The adhesion layer 2, the copper seed layer 3, the first copper plated layer 4, the second copper plated layer 5, the third copper plated layer 6, and the nickel plated layer 7 together form a stack structure of step layers in sequence tapering off upward.

The adhesion layer 2 is made of Ti or Ti/W alloy, while the thickness of the adhesion layer 2 is 100 nm to 500 nm.

The thickness of the copper seed layer 3 is 0.8 μm to 1 μm, the thickness of the first copper plated layer 4 is 10 μm to 30 μm, the thickness of the second copper plated layer 5 is 10 μm to 30 μm, the thickness of the third copper plated layer 6 is 10 μm to 30 μm, and the thickness of the nickel plated layer 7 is 100 nm to 500 nm.

The angle formed by the tangent line passing through edges of the adhesion layer 2, the copper seed layer 3, the first copper plated layer 4, the second copper plated layer 5, the third copper plated layer 6, and the nickel plated layer 7, and the surface of the aluminum nitride (AlN) substrate 1 is in a range of 15°~90°.

The first predetermined length is greater than the second predetermined length, while the second predetermined length is greater than the third predetermined length.

Figure 2:
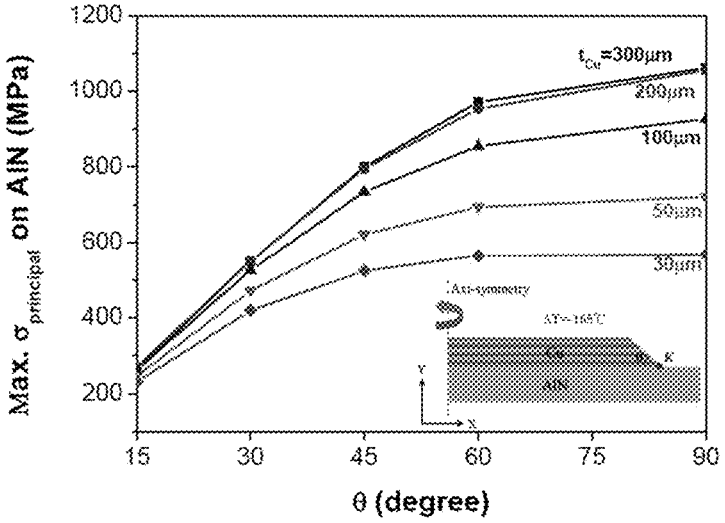
FIG. 2 is a plot indicating the stress analyses for plated-layer structure according to an embodiment of the present invention, for different thicknesses of stack structures of copper plated layers, different angles formed by a tangent line passing through edge of copper plated layer and surface of AlN substrate, in a temperature of −165° C.

Then, refer to FIG. 2 for a plot indicating the stress analyses for plated-layer structure according to an embodiment of the present invention, for different thicknesses of stack structures of copper plated layers, different angles formed by a tangent line passing through edge of copper plated layer and surface of AlN substrate, in a temperature of −165° C. In the present invention, upon completion of the plated-layer structure for improving interface stress between an AlN substrate and a copper-plated layer, tests are conducted to verify whether interface stress between an AlN substrate and a copper-plated layer does indeed improve. For this purpose, in a temperature of −165, tests are performed for various thicknesses of stack structures of the copper plated layers (namely, the stack structure of the first copper plated layer 4, the second copper plated layer 5, and the third copper plated layer 6) (30 μm, 50 μm, 100 μm, 200 μm, 300 μm), and different angles (15°, 30°, 45°, 60°, 90°) formed by tangent lines passing through edge of the stack structure of the copper plated layers and surface of the aluminum nitride (AlN) substrate 1, to calculate and analyze the stress of interface. As shown in FIG. 2, it indicates the maximum stress $\sigma_{principal}$ of major axis at K point of the aluminum nitride (AlN) substrate 1 for the test parameters mentioned above. The results show that the stress on the aluminum nitride (AlN) substrate 1 is reduced along with the decreased thickness of the stack structure of the copper plated layers. Also, since the first copper plated layer 4 is a part of the stack structure of the copper plated layers, its thickness is thinner than the entire stack structure, so that the stress on the aluminum nitride (AlN) substrate 1 in direct contact with the first copper plated layer 4 is reduced. Further, the stress on the aluminum nitride (AlN) substrate 1 is reduced along with the decrease of angle mentioned above.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A plated-layer structure for improving interface stress between an AlN substrate and a copper-plated layer, comprising:

an aluminum nitride substrate;

an adhesion layer, sputtered on the aluminum nitride (AlN) substrate for a first predetermined length horizontally, such that a tangent line passing through its edge forms a predetermined angle with a surface of the aluminum nitride substrate;

a copper seed layer, sputtered on the adhesion layer for the first predetermined length horizontally, such that the tangent line passing through its edge forms the predetermined angle with the surface of the aluminum nitride substrate;

a first copper plated layer, electroplated on the copper seed layer for the first predetermined length horizontally, such that the tangent line passing through its edge forms the predetermined angle with the surface of the aluminum nitride substrate;

a second copper plated layer, electroplated on the first copper plated layer for a second predetermined length horizontally, such that the tangent line passing through its edge forms the predetermined angle with the surface of the aluminum nitride substrate;

a third copper plated layer, electroplated on the second copper plated layer for a third predetermined length horizontally, such that the tangent line passing through its edge forms the predetermined angle with the surface of the aluminum nitride substrate; and a nickel plated layer, plated to cover and wrap around the adhesion layer, the copper seed layer, the first copper plated layer, the second copper plated layer, and the third copper plated layer, to prevent copper from being oxidized or dispersed, wherein, the adhesion layer, the copper seed layer, the first copper plated layer, the second copper plated layer, the third copper plated layer, and the nickel plated layer together form a stack structure of step layers in sequence tapering off upward.

2. The plated-layer structure for improving interface stress between AlN substrate and copper-plated layer as claimed in claim 1, wherein the adhesion layer is made of Ti or Ti/W alloy.

3. The plated-layer structure for improving interface stress between AlN substrate and copper-plated layer as claimed in claim 1, wherein thickness of the adhesion layer is 100 nm to 500 nm.

4. The plated-layer structure for improving interface stress between AlN substrate and copper-plated layer as claimed in claim 1, wherein thickness of the copper seed layer is 0.8 μm to 1 μm.

5. The plated-layer structure for improving interface stress between AlN substrate and copper-plated layer as claimed in claim 1, wherein thickness of the first copper plated layer is 10 μm to 30 μm, thickness of the second copper plated layer is 10 μm to 30 μm, and thickness of the third copper plated layer is 10 μm to 30 μm.

6. The plated-layer structure for improving interface stress between AlN substrate and copper-plated layer as claimed in claim 1, wherein thickness of the nickel plated layer is 100 nm to 500 nm.

7. The plated-layer structure for improving interface stress between AlN substrate and copper-plated layer as claimed in claim 1, wherein the angle formed by the tangent line passing through edges of the adhesion layer, the copper seed layer, the first copper plated layer, the second copper plated layer, the third copper plated layer, and the nickel plated layer, and the surface of the aluminum nitride (AlN) substrate is in a range of 15°~90°.

8. The plated-layer structure for improving interface stress between AlN substrate and copper-plated layer as claimed in claim 1, wherein the first predetermined length is greater than the second predetermined length, while the second predetermined greater is greater than the third predetermined length.

* * * * *